US005179770A

United States Patent [19]

Block et al.

[11] Patent Number: 5,179,770

[45] Date of Patent: Jan. 19, 1993

[54] MACHINE AND METHOD FOR FABRICATING A SHEET METAL STRUCTURE HAVING A CORRUGATED CORE

[75] Inventors: James P. Block, Valley Center; Stanley W. Levasheff, Huntington Beach; Gordon G. Jarosek, Westminster, all of Calif.

[73] Assignee: LCOA Laminating Company of America, Garden Grove, Calif.

[21] Appl. No.: 815,854

[22] Filed: Jan. 2, 1992

Related U.S. Application Data

[62] Division of Ser. No. 471,844, Jan. 26, 1990, abandoned.

[51] Int. Cl.[5] ..... B21D 33/00; B21D 13/04

[52] U.S. Cl. ..... 29/17.3; 29/33 S; 29/469.5; 72/196; 156/205; 156/210; 156/459; 156/470; 156/583.3; 156/583.5; 165/90

[58] Field of Search ..... 156/205, 210, 206, 208, 156/462, 459, 470, 471, 553, 583.3, 583.5; 425/369, 336; 29/469.5, 33 S, 33.5, 17.1, 17.2, 17.3; 264/286; 493/463; 72/196, 242.2; 165/89, 90; 83/353, 318, 483, 917, 492

[56] References Cited

U.S. PATENT DOCUMENTS

| | | | |
|---|---|---|---|
| 2,423,870 | 7/1947 | Blessing | 156/208 X |
| 2,767,602 | 10/1956 | Henrickson | 72/242.2 |
| 2,776,586 | 1/1957 | Sendzimir | 72/242.2 |
| 2,985,223 | 5/1961 | Thorn | 156/470 |
| 3,144,905 | 8/1964 | Albert | 165/89 |
| 3,187,809 | 6/1965 | Spears | 165/90 |
| 3,434,901 | 3/1969 | Griffiths et al. | 156/470 |
| 3,490,321 | 1/1970 | Brunson et al. | 83/318 X |
| 3,580,795 | 5/1971 | Eichenlaub | 156/583.5 X |
| 3,982,457 | 9/1976 | Berry | 83/692 X |
| 4,261,552 | 4/1981 | Kameyama et al. | 83/318 X |
| 4,755,252 | 7/1988 | Held | 156/583.5 X |
| 4,785,698 | 11/1988 | Stork | 83/318 X |

*Primary Examiner*—Michael W. Ball
*Assistant Examiner*—Michele K. Yoder

[57] ABSTRACT

Three metal foils are simultaneously fed in opposing relationship through a machine which automatically fabricates a sheet metal sandwich structure therefrom. The foils are first tensioned in aligned opposing relationship. The center sheet is then fed through a pair of free floating gear shaped corrugator tools which form corrugations or undulations therein. Adhesive is then applied to the inner surfaces of the two outer foils and the three foils passed through a pair of drums which press the foils together between opposing metal bands and provide uniform heat thereto through the bands to effect curing of the adhesive. The foils are further pressed together between the bands by means of air diaphragms or bladders which provide hydraulically controlled clamping force thereto. Finally, the sandwich structure thus formed is trimmed and cut to form boards of the desired width and length.

8 Claims, 6 Drawing Sheets

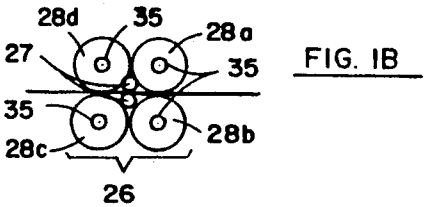
FIG. 1B
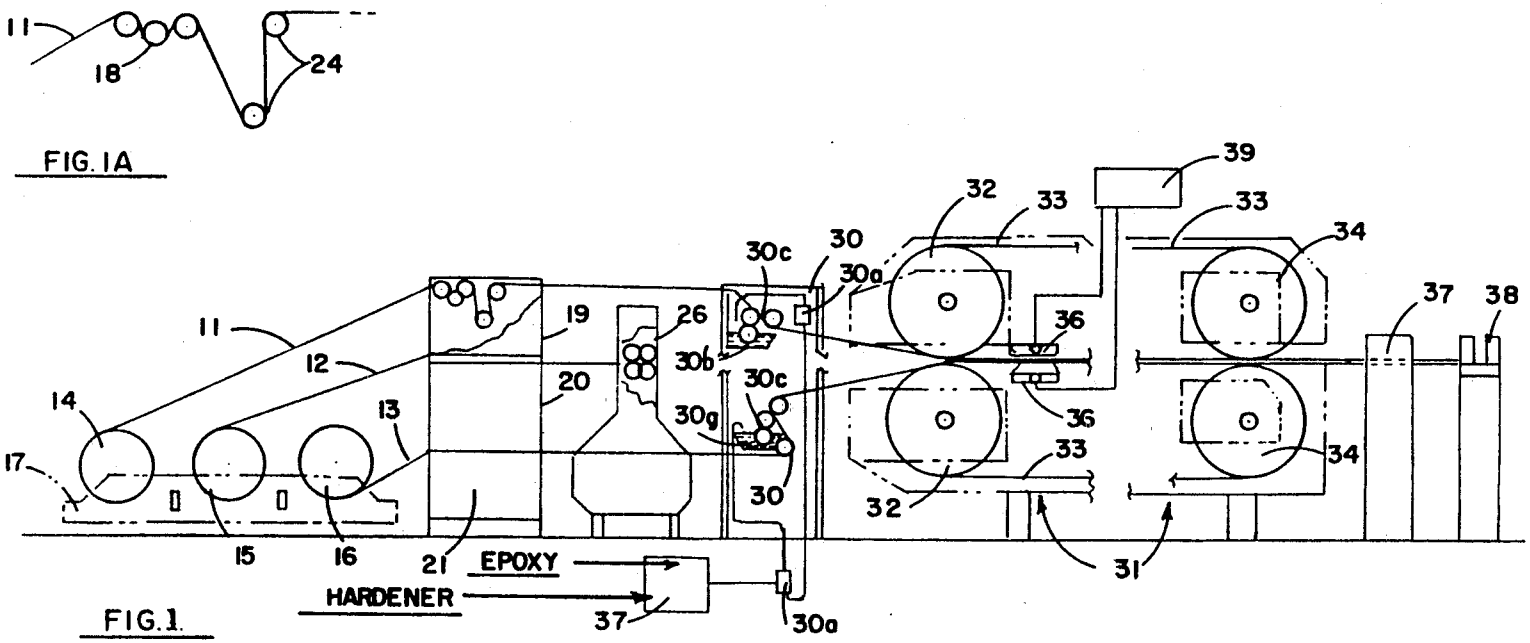
FIG. 1
FIG. 1A
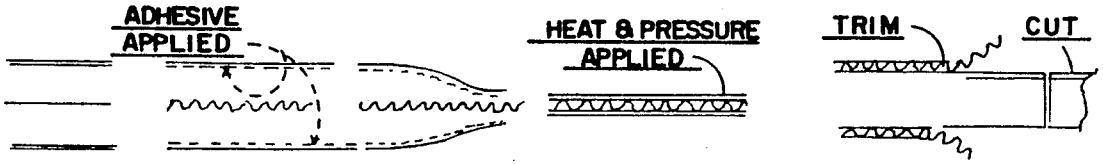
FIG. 1C

MACHINE AND METHOD FOR FABRICATING A SHEET METAL STRUCTURE HAVING A CORRUGATED CORE

This application is a division of application Ser. No. 07/471,844, filed Jan. 26, 1990, now abandoned.

BACKGROUND OF THE INVENTION

1. Field of the Invention

This invention relates to a machine and method for fabricating sheet metal sandwich structures and more particularly to such a machine and method which automatically fabricates such structures from flat metal foils.

2. Description of the Related Art

Sheet metal sandwich core panel structures are useful as backup material in the drilling of circuit boards. A method for using such backup material in this fashion is described in U.S. Pat. No. 4,269,549 issued May 26 1961 and assigned to LCOA, Laminating Company of America, the assignee of the present application. This type of structure also is used extensively as high strength to weight ratio panels in aircraft and in other applications.

Machines have been developed in the prior art for fabricating this type of structure. One such machine is described in G. W. Blessing U.S. Pat. No. 2,423,870, issued Jul. 15, 1947. In the machine described in this patent, a pair of outer metal foils or "skins" are joined to an inner sheet which is corrugated by being passed between a pair of corrugating rollers which are rotatably supported on support shafts. Adhesive is then applied to the surfaces of both the outer skins and the corrugated inner sheet and heat and pressure applied against the outer skins to bond the three foils together to form a composite structure.

While the basic steps followed by the Blessing machine are sound enough for forming many desired structures, it has been found that problems are presented in the mass production of such structures, particularly in situations where relatively wide panels are to be formed (of the order of 3 feet wide or greater). One of these problems is bending and deflection of the central panel during the corrugation step which results in a non-uniform often skewed core which is unsatisfactory particularly for applications for backup board such as described in the aforementioned U.S. Pat. No. 4,269,549. Further it has been found that unless special steps are taken to insure uniform heating of the panels that inadequate bonding of the structure is likely to occur. It is also important in achieving proper bonding that the foils be pressed against each other with uniform force over the entire surface thereof and that such force be precisely controlled to provide enough pressure to assure proper bonding of the structure but avoiding using so much force as to cause damage thereto.

BRIEF SUMMARY OF THE INVENTION

The machine and method of the present invention obviates the aformentioned shortcomings of the prior art particularly in forming panel structures having larger widths (three feet or greater). This end result is achieved by incorporating improvements in the machine and method employed thereby which relate to 1. the corrugating of the center sheet, 2. the curing of the adhesive for bonding the foils together, and 3. the pressing of the foils together in forming the integral structure.

Briefly described, the invention is as follows: Three metal foils are fed into the machine in spaced apart opposing relationship and tensioned by the machine so that they will feed into the machine and track therethrough in a flat uncrinkled condition. The center foil is passed through a corrugator which is formed by a pair of small diameter gear-like corrugator tools which are left floating, these corrugator tools being surrounded by and driven by a cluster of four larger diameter gears, at least one of which is driven by a drive motor. It has been found that the use of floating tools for the corrugator members tends to avoid bending and deflection which deforms the corrugated core, this often occurring when such tools are supported on bearings. The drive gears form a cluster around the corrugator tools and due to their greater diameter and bearing support structure resist deflection.

After the central foil has been corrugated, the outer foils are passed through an adhesive applicator which applies adhesive to the inner surfaces thereof. A pair of endless metallic bands are driven between pairs of cylindrical metal drums. The two outer foils are pressed against the center foil by means of the metallic bands which are driven towards each other by two of the drums which are in opposing relationship. The cylindrical surfaces of the two opposing drums are uniformly heated by passing heated liquid through channels formed adjacent to their surfaces. A pair of such channels is formed in each drum, the channels of each pair being alternately arranged in interposition with each other. Heated fluid is passed through one channel of each pair in one direction and the other channel in an opposite direction such that any cooling of fluid which may occur towards the end of any channel will be compensated for by fluid flowing through the adjacent channel in the opposite direction. This assures uniform heating throughout the entire extent of the drum surfaces.

The two outer foils are then pressed against the center sheet by means of pneumatically driven diaphragm members which drive against the opposing band members which in turn press against the outer foils. The pressure exerted by the diaphragm members is precisely controlled by a pneumatic control so that optimum force can be exerted without placing too much force on the structure which might cause damage thereto. The diaphragm members run along substantially the entire opposing portion of the surface of each of the bands so as to provide uniform pressure throughout these surfaces. Finally, with the foils joined together to form an integral structure, the sandwich structure is fed to a trimmer which trims the sides and a cutter which cuts the sandwich structure to boards of the desired length.

It is therefore an object of this invention to facilitate the fabrication of sandwich panel structures;

It is a further object of this invention to provide a machine for fabricating sandwich panel structure which is capable of producing such a structure having a uniform corrugated core and a uniform high strength bonding of the outer foils to such core.

Other objects of the invention will become apparent from the following description in connection with the accompanying drawings.

DESCRIPTION OF THE DRAWINGS

FIG. 1 is a side elevational view schematically illustrating a preferred embodiment of the invention;

FIG 1A is a side elevational view of the foil tracking tensioning assembly of the preferred embodiment;

FIG 1B is a side elevational view of the corrugator of the preferred embodiment;

FIG 1C is a diagrammatic illustration showing the sequential operations of the preferred embodiment;

DETAILED DESCRIPTION OF THE INVENTION

Figure 2:
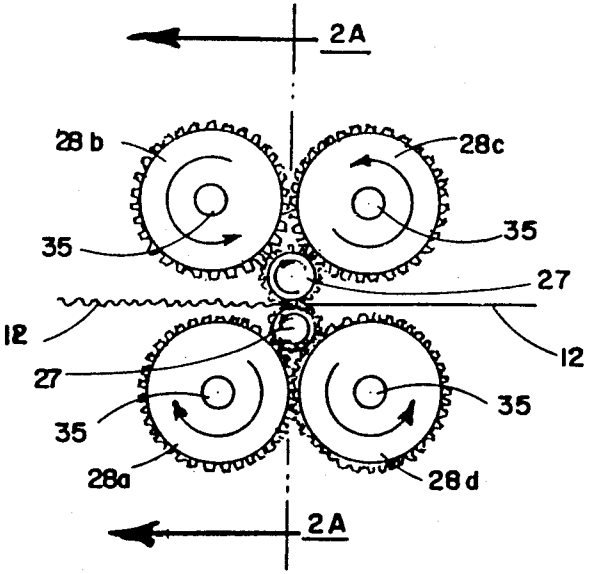
FIG. 2 is a side elevational view of the corrugator of the preferred embodiment.

Referring to FIGS 1, and 1A-1C, the preferred embodiment of the invention is schematically illustrated.

Reels 14-16 which are rotatably supported on stand 17 have three metal foils 11-13 respectively wound thereon. These foils may be of an aluminum alloy having a thickness of about 0.005 inches. The foils of aluminum are fed off the reels to of similar separate tensioning and tracking assemblies 19-21 respectively. Input rollers 18 are provided in each of these assemblies which have sensors (not shown) for sensing the foil tension and in response to such measurement to provide signals to a servo control system to control brakes provided on each of the reels 14-16 to assure proper tensioning of the foils. At the exit of assemblies 19-21 rollers 24 are provided which have one of their ends adjustable so that the tracking (steering) of the foils can be adjusted should any misalignment occur.

After having passed through the tracking and tensioning assembly, the center foil 12 is passed through corrugator assembly 26. This assembly comprises centrally located gear-like corrugator tools 27 which are left floating (i.e. have no bearings) and are held between and rotatably driven by substantially larger diameter drive gears **28*a*-28*d* which are mounted on shafts 35 and which are rotatably driven by a suitable drive motor. One or more of the drive gears may be driven by the motor with the remaining gears forming part of a gear train. As to be shown further on in the specification, the corrugator tools extend over a relatively long distance (4-6 feet) but need not be of large diameter to avoid bending deflection in view of their being left floating i.e. not supported on bearings. The bearing loads encountered in driving the corrugator tools against foil 12 in effecting the corrugation thereof are borne by the bearings of the outer larger diameter gears 28*a*-28*d* which can handle such loads without deflecting. Drive gears 28*a*-28*d*** are formed in separate bearing supported sections.

The foils are then fed through adhesive applicators 30 where adhesive is applied to the inner surfaces of foils 11 and 13. A suitable adhesive such as, for example, an epoxy-resin having a 50—50 composition of epoxy and hardener may be employed. The resin and hardener are supplied from storage tanks (not shown) to a mixing manifold 37 where the resin and hardener are mixed. The adhesive is then fed through control valves **30*a* to pans 30*b*. The adhesive is applied to the inner surfaces of foils 11 and 13 by means of roller wheels 30*c***, one of which is rotatably mounted in the adhesive and the other of which draws adhesive from the first wheel and applies it to the associated foil.

The three foils are next fed to pressing assembly 31 where the three foils are pressed together to form the integral sandwich core structure. The foils are first compressed between a pair of endless metal bands 33 which run around and between cylindrical drums 32 and 34. Drums 32 and 34 are uniformly heated over their entire cylindrical surfaces by a unique hydraulic heating system, as to be explained further on in the specification. This heat is applied from the drums 32 and 34 through bands 33 to the surfaces of the foils to cure the adhesive. Compression force is then further applied to the foils through bands 33 by means of pneumatic diaphragms 36 which are mounted on opposite sides of the bands. This compression force is uniformly applied over the entire surfaces of a substantial length of the outer foils and is accurately controlled by a pneumatic control system incorporated into pneumatic supply source 39 which supplies pressure to the diaphragms. The diaphragms are supported on heated platens 29 (See FIG. 4). The sandwich core board thus formed is then fed to trimmer 37 which trims the board to the desired width and cutter 38 which cuts the boards to the desired length.

Figure 2A:
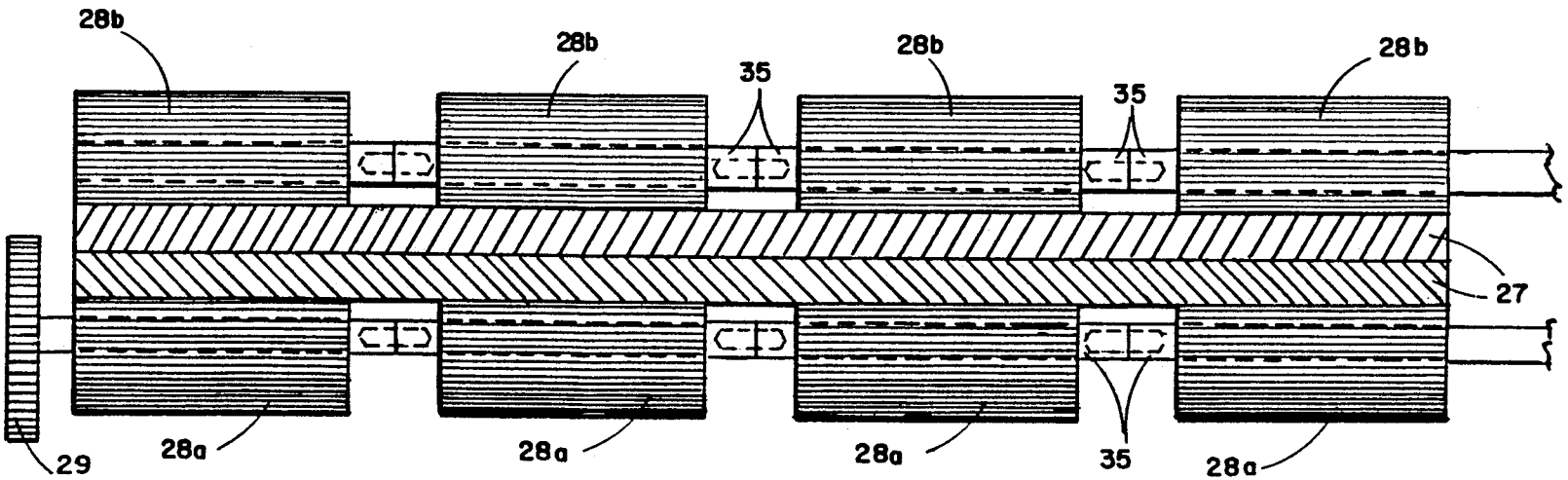
FIG. 2A is a view taken along the plane indicated by 2A—2A in FIG. 2.
Figure 3:
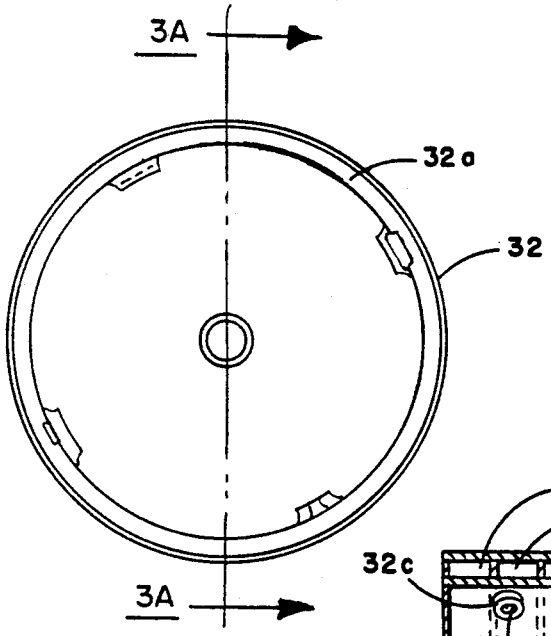
FIG. 3 is an end elevational view of the heating drum of the preferred embodiment.
Figure 3A:
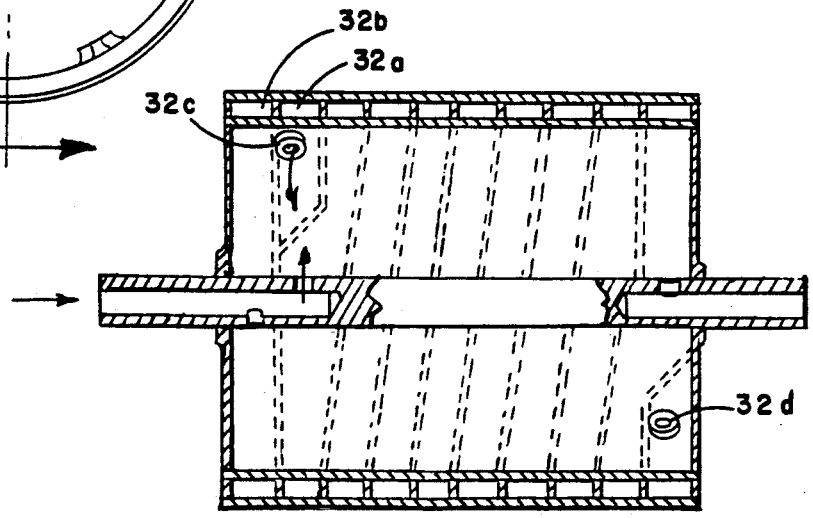
FIG. 3A is a cross sectional view taken along the plane indicated by 3A—3A in FIG. 3.
Figure 3B:
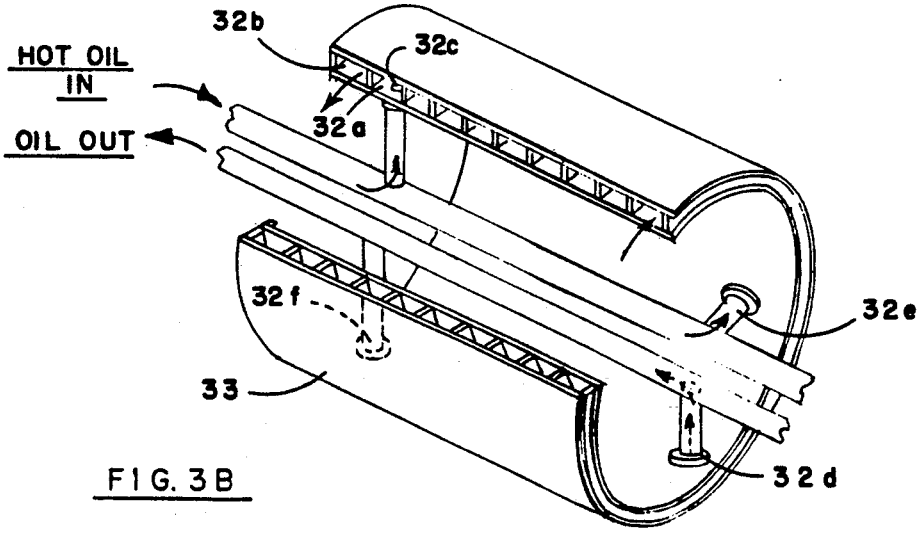
FIG. 3B is a perspective view of the heating drum of the preferred embodiment with a partial cut-away section.

Referring now to FIGS. 2 and 2A, the corrugator of the preferred embodiment is shown. Drive gears **28*a*-28*d* are separately rotatably supported on drive shafts 35 and are arranged in clusters around corrugator tools 27 which are floating. The corrugator tools are driven in opposite directions to pass foil 12 therebetween and effect the corrugation thereof. The sets of drive gears 28*a*-28*d* may be driven by a single drive which engages gear 29 which in turn is driven by a motor (not shown). A pair of drives or individual drives for each drive gear may also be employed. As can be seen, the corrugator tools have a substantially smaller diameter than the drive gears. The larger diameter drive gears with their individual bearings and support shafts are capable of resisting bending forces and thus maintain their positions without deflection under high loads. The corrugator tools which are floating are maintained in position by the larger drive gears and in this manner, skewing or other deflection is avoided, thus assuring a uniformly corrugated central foil. Referring now to FIGS. 3, 3A and 3B, the heated drums 32 (and drums 34 which are similar to drums 32) of the preferred embodiment are illustrated. As pointed out above, these drums not only operate to press the three foils together but also provide uniform heat to the foils to effect the curing of the adhesive applied to the inner surfaces of the outer foils. A pair of channels 32*a* and 32*b* which are interposed with each other is provided along the surface of each drum. Heated liquid is inletted into channel 32*a* at one end of the drum surface and outletted from this channel at the opposite end of this surface. The fluid is passed in an opposite direction through channel 32*b* and is inletted at inlet 32***e* which is at the end of the drum where the fluid is outletted from channel 32*a* and returned through outlet 32*f* as shown in FIG. 3B. Thus, the heating of the drum is kept uniform by virtue of the fact that assuming the fluid will cool relatively uniformly over its flow path between the inlet and outlet, the cooling of each channel towards its outlet end will be compensated by the inlet fluid flowing in the opposite direction through the adjacent channel. This uniform heating of the drums helps to assure uniform curing of the adhesive.

Figure 4:
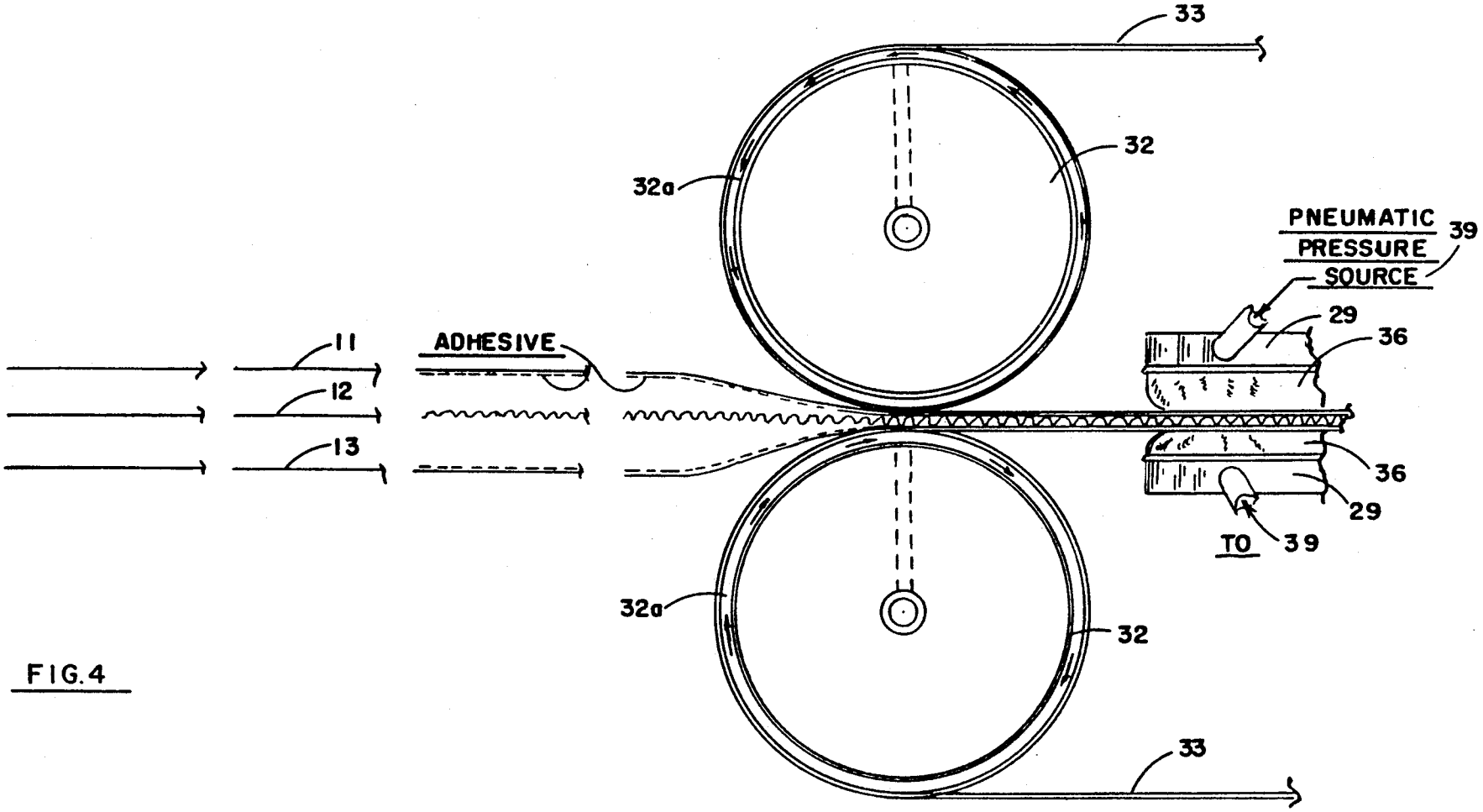
FIG. 4 is a side elevational view of the heating drums and pneumatic diaphragms of the preferred embodiment shown in operation.

Referring now to FIG. 4, the details of the operation of the invention in compressing the three foils together to form a composite structure is illustrated. The three foils 11–13, with the central foil 12 corrugated are passed between metallic bands 33 which run between drums 32 and 34 and are driven thereby. The bands are compressed against the foils by the drums 32 and 34 which as noted provide heat to the foils to effect the curing of the adhesive applied to the outer foils. Further uniform compression is provided to the foils by pneumatic diaphragms 36, the pressure of which is controlled by means of a pneumatic control system 39. Thus, uniform pressure is provided against the entire surfaces of the foils over a substantial length thereof. The diaphragms are mounted on heated platens 29 which provide heat thereto. The pneumatic pressure applied to the diaphragms is continually monitored and decreased or increased to provide optimum compression force.

Figure 5:
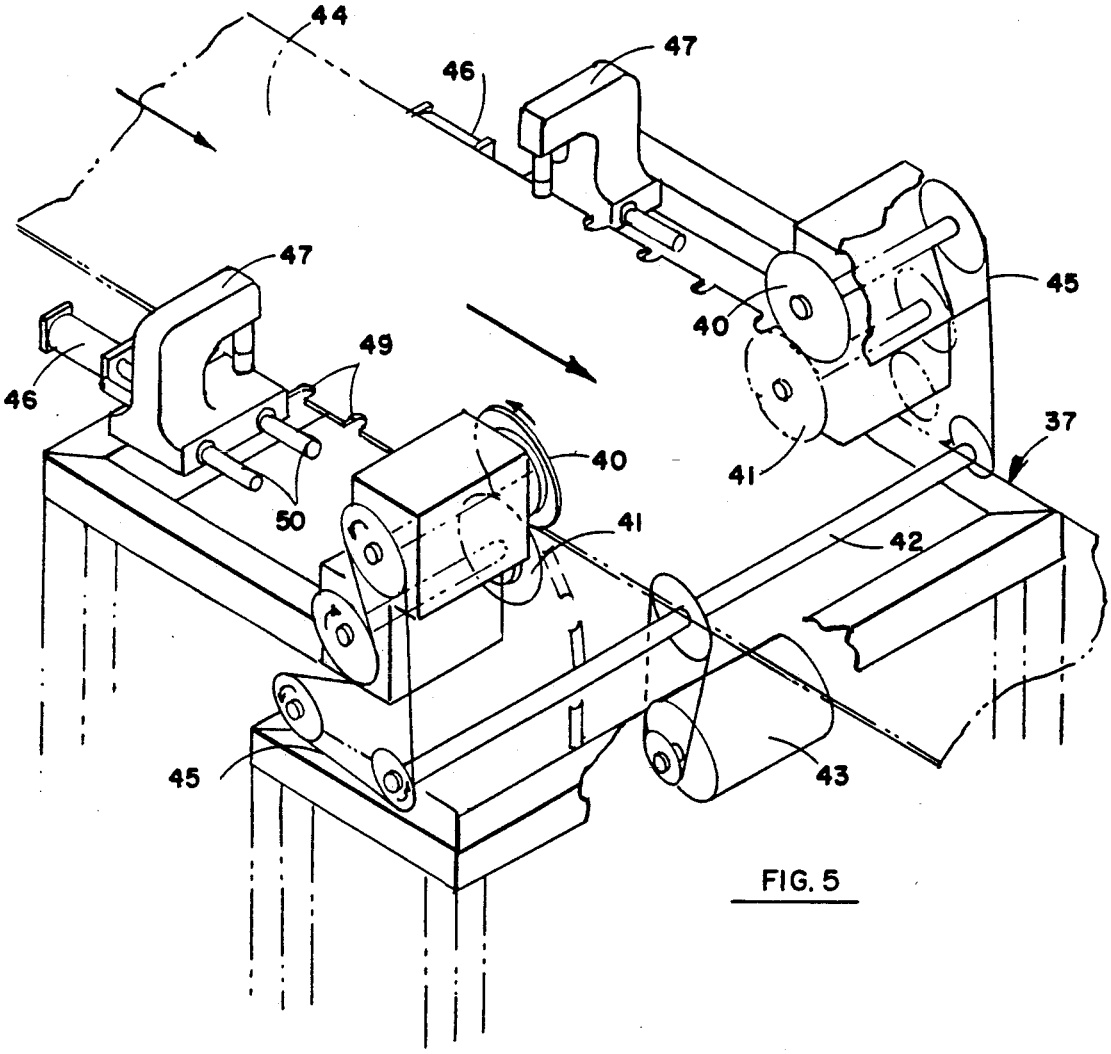
FIG. 5 is a perspective view of the trimmer of the preferred embodiment.

Referring now to FIG. 5, the edge trimmer of the preferred embodiment is illustrated. Sandwich core foil assembly 44 formed from foils 11–13 is first moved past pneumatic notching punches 47 which operate to form notches 49 along the edges of foil assembly 44. Punches 47 are slidably mounted on slides 50 and are driven along the slides by means of pneumatic cylinders 46. The cylinders are controlled by a suitable control system which effects driving of the punches in synchronization with the movement of the sandwich core panel structure 44. After each punching operation is completed, the punches are returned to their starting position by the cylinders 46. The notching of the panel structure separates the edge scrap into small easily manageable pieces which are cut off by means of rotary slitting blades 40 operating in conjunction with anvils 41. The blades are driven by means of serpentine chain drives 45 which are in turn driven by drive shaft 42. The drive shaft 42 is rotatably driven by means of motor 43 which is synchronized by means of a control system to provide the edge trimming as required.

Figure 6A:
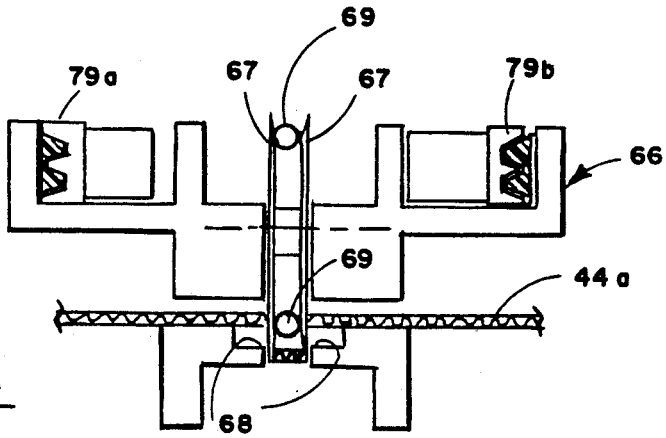
FIG. 6A is a cross sectional view taken along the plane indicated by 6A—6A in FIG. 6.
Figure 6:
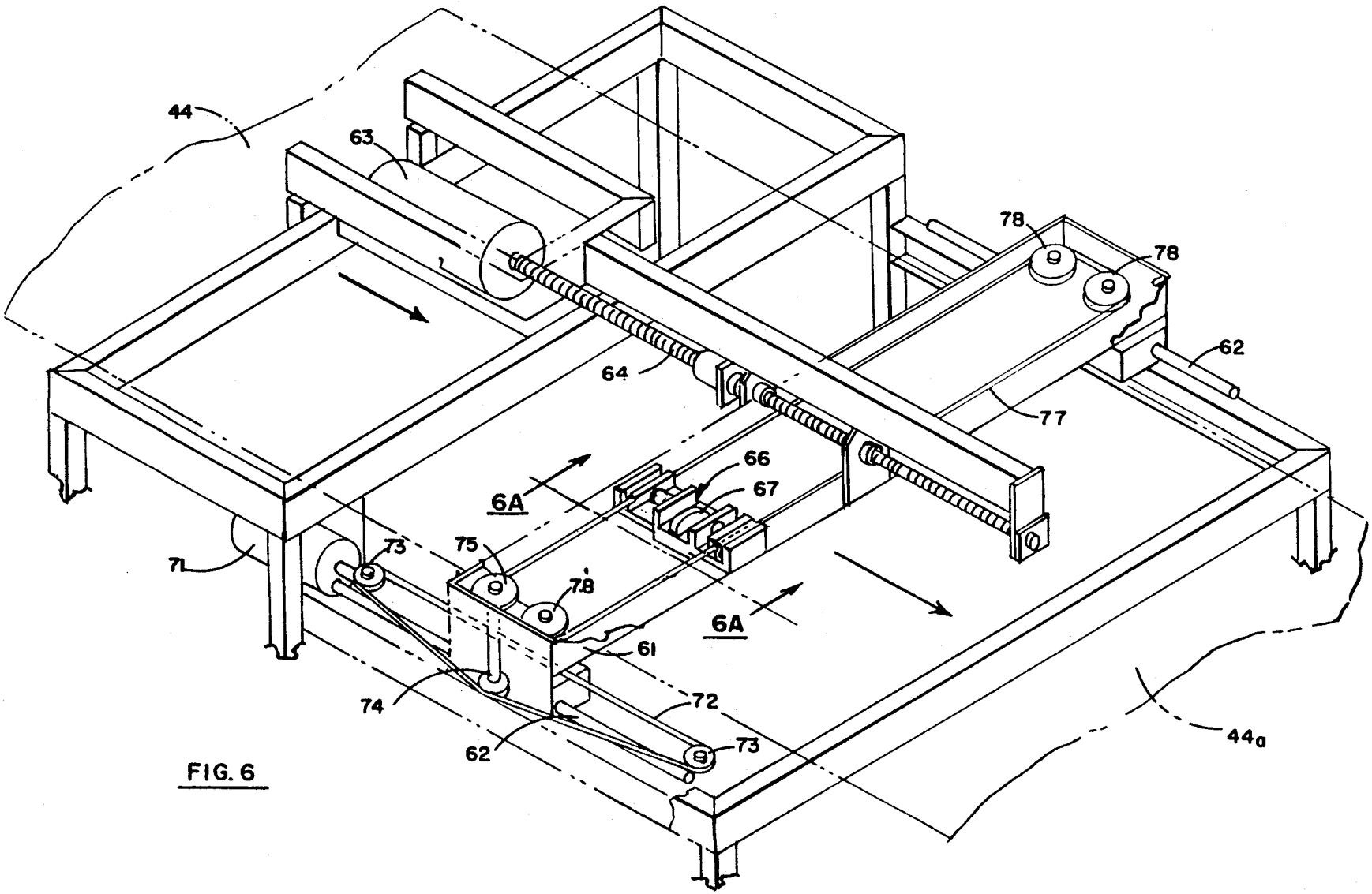
FIG. 6 is a perspective view of the cutter of the preferred embodiment.

Referring now to FIGS. 6 and 6A, the cutter of the preferred embodiment of the invention is illustrated. Support carriage 61 is slidably mounted on slides 62. The carriage is driven along the slides by means of motor 63 which rotatably drives lead screw 64 which in turn threadably engages a pair of brackets which extend from the carriage. Motor 63 is controlled by a control system which drives the carriage in synchronism with the movement of the sandwich core structure. After the cut has been completed the motor 63 is reversed and the carriage returned to its starting position.

Blade carrier 66 is slidably mounted on carriage 61 for transverse movement thereacross. As can best be seen in FIG. 6A, the blade carrier has a pair of opposing similar circular blades 67 mounted thereon which operate cooperatively with mating anvils 68 in cutting the material 44 into boards 44*a*. Anvils 68 extend across substantially the entire length of carrier 61. An "O" ring spring 69 is fitted between the paired blades to provide pressure between the circular blades and their associated anvils which not only compensates for tolerance variations but assists in providing for a self sharpening action of the blades against the anvils. Blade carrier 66 is driven in either direction along carriage 61 by means of drive motor 71 which drives chain drive 72 through pulley wheels 73. The chain drive in turn drives shaft 74 and the pulley wheel 75 attached thereto. The pulley wheel drives endless belt 77 on idler wheels 78.

A pair of pneumatically operated clamps 79*a* and 79*b* are mounted on the blade carrier and are employed to clamp the carrier to the belt so that it is driven thereby to perform the cutting action. For cutting in one direction, the clamp 79*a* is actuated while for opposite direction cutting the clamp 79*b* is actuated, the actuation of the clamps being controlled by a control system. The blade carrier is thus driven in one direction and then in the opposite direction to cut the material into boards. By using a pair of blades and excising a small strip of waste material out therebetween, clean straight edges are assured on both ends of the boards.

The machine of the present invention may also be used to form sandwich structures which do not have a corrugated core. This can be accomplished merely by removing the corrugator tool 26 and feeding the central foil through to the drums without any processing. A suitable paper product may be substituted for foil 12. Also, a laminate may be formed of different metal alloys, plastic, paper or other material substituted for foils 11–13 with or without corrugation of the central foil 12.

The machine and method of this invention thus provides means for fabricating a panel sheet structure which can be used as backup board for drilling printed circuit boards or for structural purposes.

While the invention has been described and illustrated in detail, it is to be clearly understood that this is intended by way of illustration and example only and not by way of limitation, the scope of the invention being limited only by the terms of the following claims.

We claim:

1. A machine for fabricating a sheet sandwich structure having a corrugated core from three foils comprising:

means for feeding said foils in spaced apart opposing relationship to each other, one of said foils forming a central foil which is positioned between the other two of said foils which form outer foils, means for tensioning said foils to maintain them in a flat uncrinkled condition as they are being fed, a corrugator formed by a pair of opposing corrugator tools and a cluster of drive gears surrounding said corrugator tools, said corrugator tools having a substantially smaller diameter than said drive gears, said corrugator tools being supported in a floating condition between said drive gears and being rotatably driven thereby, bearing means for rotatably supporting said drive gears, said central foil being fed between said corrugator tools, corrugations thereby being formed therein, means for applying adhesive to the inner surfaces of said outer foils, a pair of opposing cylindrical drums, means for uniformly heating the cylindrical surfaces of said drums, said foils being fed between the cylindrical surfaces of said drums with the central foil sandwiched between the outer foils, said foils being pressed together by said drums and uniformly heated thereby to cure the adhesive.

means for applying uniform pressure over the entire surfaces of the outer foils to effect the joinder thereof with the central corrugated foil to form an integral structure, and means for cutting said integral structure into sheets of a predetermined size.

2. The machine of claim 1 wherein the means for uniformly heating the surfaces of said drums comprises a pair of fluid channels formed immediately beneath and running over substantially the entire extent of the cylindrical surfaces of said drums, said channels being interposed with each other, heated fluid being fed through said channels in opposite directions.

3. The machine of claim 1 wherein said means for applying uniform pressure over the entire surfaces of said outer foils comprises fluid actuated diaphragm means, said foils being passed between said diaphragm means.

4. The machine of claim 3 wherein said diaphragm means comprises a plurality of bladder diaphragm elements mounted in opposing relationship, and further including a second pair of heated drums spaced from said first pair of drums, and a pair of endless metal bands which are driven around between each of the drums of said first and second pair of drums in opposing relationship, said outer foils with the central corrugated foil sandwiched therebetween being fed between said bands, said diaphragm elements applying force against said bands to cause the bands to press the outer foils against said central foil.

5. The machine of claim 1 and further including a second pair of opposing drums spaced from said first mentioned pair of drums and an endless metal band wound around and driven between each of the drums of said first pair of drums and a corresponding one of the drums of said second pair of drums, the foils being fed between said bands.

6. A method for fabricating a sheet metal sandwich structure having a corrugated core from three metal foils comprising:

feeding said foils in spaced apart opposing relationship to each other, one of said foils forming a central foil which is positioned between the other two of said foils which form outer foils, tensioning said foils to maintain them in a flat uncrinkled condition as they are being fed, feeding the central foil between a pair of opposing corrugator tools, corrugations thereby being formed therein, said corrugator tools, being supported in a floating condition between a plurality of surrounding drive gears which rotatably drive the corrugator tools, applying adhesive to the inner surfaces of said outer foils, uniformly heating the cylindrical surfaces of a pair of opposing cylindrical drums, feeding said foils between the cylindrical surfaces of said drums with the central foil sandwiched between the outer foils, said foils being pressed together by said drums and uniformly heated thereby to cure the adhesive, applying uniform pressure over the entire surfaces of the outer foils to effect the joinder thereof with the central corrugated foil to form an integral structure, and cutting said integral structure into sheets of a predetermined size.

7. The method of claim 6 wherein the surfaces of the drums are uniformly heated by feeding the heated fluid through a pair of interposed fluid channels formed immediately beneath and running over substantially the entire extent of the cylindrical surfaces of said drums, the heated fluid being fed through said channels in opposite directions.

8. The method of claim 6 wherein uniform pressure is applied over the entire surfaces of the outer foils by means of fluid actuated diaphragm means, the fluid pressure of said diaphragm means being controlled.

* * * * *